United States Patent [19]

Fast

[11] Patent Number: 4,497,464

[45] Date of Patent: Feb. 5, 1985

[54] SUPPORT HOOK AND ASSEMBLY FOR MERCHANDISING DISPLAY

[76] Inventor: Jacob Fast, 7561 NW. 9th St., Plantation, Fla. 33317

[21] Appl. No.: 422,303

[22] Filed: Sep. 23, 1982

Related U.S. Application Data

[63] Continuation-in-part of Ser. No. 358,868, Mar. 17, 1982, Pat. No. 4,476,983.

[51] Int. Cl.[3] ..... E04G 3/00

[52] U.S. Cl. ..... 248/220.3; 24/370; 211/113; 211/57.1

[58] Field of Search ..... 248/220.3, 225.1, 225.2, 248/223.3, 221.4, 303, 215, 304; 24/230.5 AD, 370; 108/30, 29; 211/119, 113, 54.1, 57.1, 59.1, 106

[56] References Cited

U.S. PATENT DOCUMENTS

| | | | |
|---|---|---|---|
| 643,818 | 2/1900 | Headland | 211/113 |
| 913,955 | 3/1909 | Hansen | 211/113 |
| 3,430,301 | 3/1969 | Venus | 24/370 |
| 3,440,792 | 4/1969 | Schmidgall | 24/370 X |
| 3,477,677 | 11/1969 | Hindley | 248/220.3 |
| 3,532,318 | 10/1970 | Lloyd | 248/220.4 X |
| 3,815,756 | 6/1974 | Cox | 211/57.1 |
| 4,027,842 | 6/1977 | Mittleman | 248/215 X |
| 4,094,415 | 6/1978 | Larson | 211/57.1 |

FOREIGN PATENT DOCUMENTS

| | | | |
|---|---|---|---|
| 1103725 | 11/1955 | France | 24/370 |

*Primary Examiner*—Ramon S. Britts
*Assistant Examiner*—Sarah A. Lechok
*Attorney, Agent, or Firm*—Holman & Stern

[57] ABSTRACT

Apertured blister packs or the like are displayed by being suspended from beyond the edge of a shelf by means of an integrally-formed hook which attaches to the shelf. Attachment is either through apertures in the shelf or to a shelf price molding with the aid of a resilient member. When the hook is secured directly to the shelf, the resilient member is an elastic band which positionally biases the hook against the price molding. The hook may be attached instead to a resilient spring clip which is selectively resiliently engaged in the price molding. A projecting portion of the hook is a ring having a small annular gap which permits apertures of the blister packs to be placed on the ring and suspended therefrom for display purposes.

12 Claims, 16 Drawing Figures

SUPPORT HOOK AND ASSEMBLY FOR MERCHANDISING DISPLAY

CROSS-REFERENCE TO RELATED APPLICATION

This application is a continuation-in-part of my U.S. Patent Application Serial No. 06/358,868, filed Mar. 17, 1982 and entitled "Support Hook And Assembly For Merchandising Display", now U.S. Pat. No. 4,476,983.

TECHNICAL FIELD

The present invention relates to apparatus for displaying blister packs or other items which are apertured so as to be suspended from a hook at a location beyond the edge of a shelf for supporting other merchandise.

BACKGROUND OF THE INVENTION

It is common practice to support blister packs and the like for display forwardly of a shelf by means of J-hooks or similar hanger mechanisms which include a generally horizontally-supported rod which extends forwardly from the shelf. The apertured blister packs or similarly apertured items for display are suspended from the rod at an appropriate height to present an eye-catching display. Unfortunately, such arrangements have been "eye-catching" in an all too literal sense. Specifically, customers have been known to inflict serious eye damage on themselves by jamming the hanger rod into an eye while bending over to reach for an item on a lower shelf. Some attempts have been made to avoid this problem but have resulted in other problems which have rendered the attempted solutions impractical. These other problems include unnecessary space consumption for the hanging mechanism, relatively complex configurations which increase the cost and fabrication complexity, and undesirable orientation of the supported blister pack or other product.

SUMMARY OF THE INVENTION

It is an object of the present invention to provide a display arrangement for apertured blister packs or the like which is simple and inexpensive to manufacture and easy to install. It is a further object of the present invention to provide a support hook which eliminates the danger of damage to a customer's eye while supporting apertured blister packs or the like in a desirable orientation for display purposes.

In accordance with the present invention, a support hook takes the form of a rod which is bent in a single plane to have a ring at one end for supporting items for display and a mounting configuration at the other end for securing the support hook to a shelf with the ring extending forwardly of the shelf end. The ring has a small angular gap formed where one end of the member is spaced from the mounting portion so as to permit the apertured blister packs to be inserted onto the ring. In one embodiment, the support hook is adapted for use with shelves having one or more holes defined therethrough proximate the shelf edge so that the mounting portion of the hook engages the shelf by extending through a shelf hole. In this embodiment, the mounting portion may be configured to permit the support hook to engage the shelf in a snap-fit with the rearward end of the ring abutting the shelf edge. Alternatively, the mounting portion of the support hook may be bent so that it engages the underside of the shelf for stability. Instead of engaging the underside of the shelf, the bent mounting portion may be made somewhat shorter and a rubber band or the like may be stretched between the mounting portion and support hook so as to resiliently extending around the price molding, thereby positionally stabilizing the hook with respect to the price molding. The hook need not be employed with a shelf requiring holes for purposes of supporting the hook. Under such circumstances, the hook may be supported along a price molding between the price molding itself and a flexible cardlike member engaged at its edges in a state of flexure in the price molding; or, the hook may be attached to an apertured spring clip which engages the price molding in a state of flexure. All of the support hook embodiments are made in one (1) piece, either metal or plastic, with all bends formed in a common plane. The support hook can therefore be simply and inexpensively stamped or molded or otherwise formed for mass production. The support ring has no exposed ends which can inadvertently injure a customer. In addition, the ring structure causes apertured blister packs or the like to automatically hang in an easily seen position as is desirable for displaying merchandise.

BRIEF DESCRIPTION OF THE DRAWINGS

The above and still further objects, features, and advantages of the present invention will become apparent upon consideration of the following detailed description of specific embodiments thereof, especially when taken in conjunction with the accompanying drawings, wherein.

DESCRIPTION OF THE PREFERRED EMBODIMENTS

Figure 1:
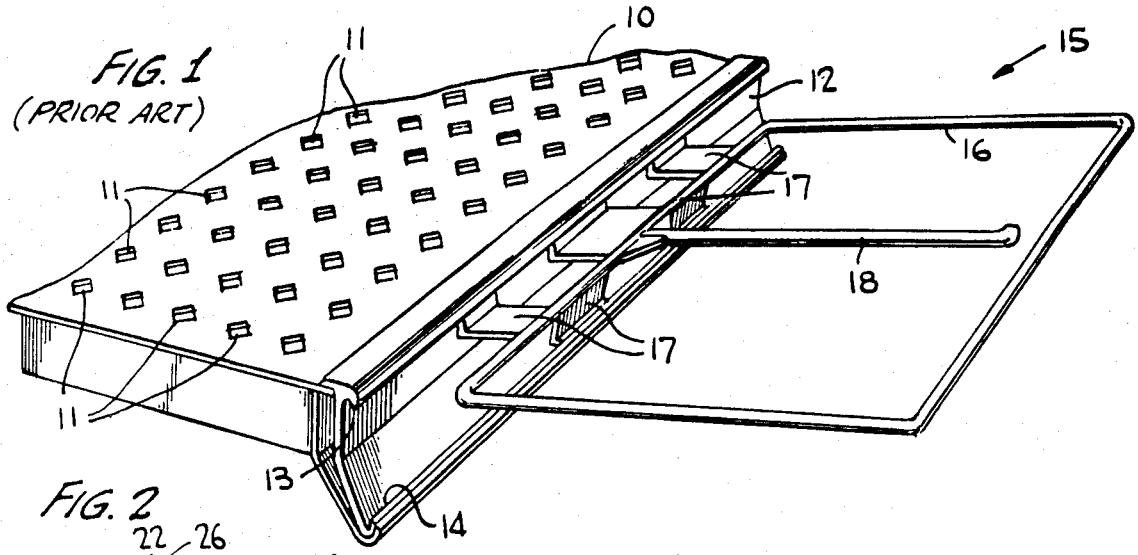
FIG. 1 (PRIOR ART)
FIG. 1 is a view in perspective of a prior art arrangement for displaying merchandise of the type with which the present invention is concerned.

Referring in detail to FIG. 1 of the accompanying drawings, a prior art device for supporting apertured blister packs or the like is illustrated. Specifically, a commonly employed horizontally-disposed merchandise shelf 10 is provided with a plurality of through holes 11 and is fitted with a price molding 12 along its forward edge. The price molding 12 is provided with horizontally-extending upper grooves 13 and lower grooves 14 formed by respective bent-over lips of the price molding structure. A merchandise support and display member, generally indicated at 15, includes a rectangular frame member 16 from which plurality of tongue-like members 17 extend rearwardly to resiliently engage grooves 13 and 14 so as to support the frame forwardly of the price molding. A hanger 18 extends from the same side of the frame inwardly thereof to a location just short of the opposite frame side. This space between hanger member 18 and the opposite frame side is used to permit inspection of apertured blister cards or the like over the hanger member 18 from which the blister cards are suspended for merchandising display purposes.

The display arrangement 15 described above is commonly called a J-hook and is modified from the earlier J-hooks by frame 16. Specifically, in the absence of frame 16, the hanger member 18 projects forwardly of the shelf 10 in an unprotected manner and resulted in numerous injuries to passers by and customers who, in bending to reach for an article on a lower shelf, did not focus their vision on hanger 18 and damaged their eyes and other vulnerable portions of the head area. Frame 16 was provided to prevent this, the theory being that the larger area of the frame would be more likely to be noticed by a customer and that the frame would protect against inadvertent injury by hanger 18. However, in practice, frame 16 tends to flex when impinged upon, thereby exposing the distal end of hanger 18. The likelihood of injury is reduced somewhat, but not entirely. Moreover, the structure of the framed J-hook takes up considerable space and requires a relatively complex mold which increases fabrication costs. These problems have been obviated by the present invention.

Figure 2:
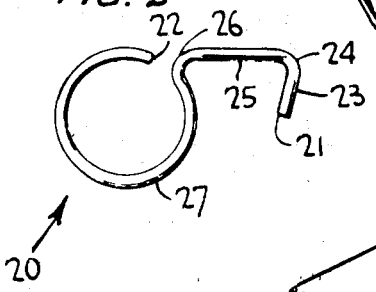
FIG. 2 is a view in plan of a support hook configured in accordance with one aspect of the present invention.
Figure 3:
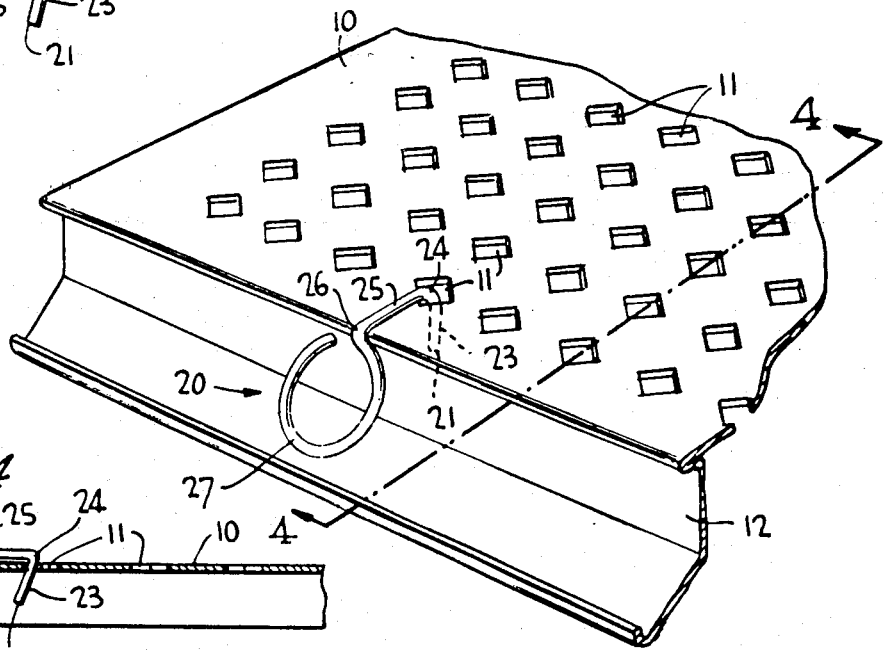
FIG. 3 is a view in perspective of the support hook of FIG. 2 deployed on a shelf for purposes of display.
Figure 4:
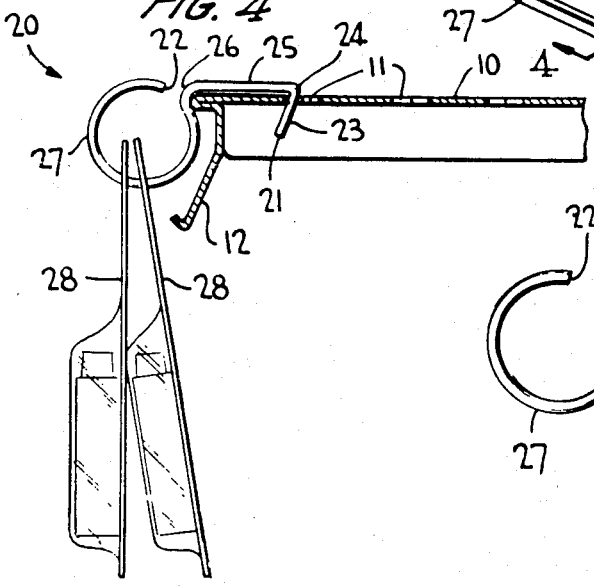
FIG. 4 is a view in section taken along lines 4—4 of FIG. 3 and adding items suspended from the support hook to illustrate its utility.

Referring to FIGS. 2, 3 and 4 specifically, a support hook 20 of the present invention includes a single rod member which is bent in a single plane to form the hook structure. The rod has a first end 21 and a second end 22. A first length of the rod 23 extends from end 21 to a bend 24 of approximately 105°. The other side of the bend includes another length of straight rod section 25 which terminates in a similar bend 26 that tangentially joins a ring portion 27 which terminates at the opposite rod end 22. Rod end 22 is spaced from bend 26 by a short distance to provide a gap in ring 27 which is sufficient to permit a blister pack 28, or similar items for display, to be suspended from the ring.

As best illustrated in FIG. 3, a shelf 10, similar to the shelf of FIG. 1, includes a price molding 12 extending horizontally along its forward edge. Shelf 10 is apertured with holes 11, some of which are in close proximity to the price moldong 12. The support ring 20 includes a mounting portion which comprises end 21 and sections 23 and 25. This mounting portion is adapted to engage shelf 10 through one of the holes 11 therein which is disposed proximate price molding 12. Specifically, support ring 20 is disposed so that end section 23 is inserted down through a hole 11 until stopped by bend 24. In this regard, it is preferred that the spacing between rod end 21 and the nearest portion of ring 27 is less than the spacing between aperture 11 and the nearest point of price molding 12. This requires the support hook 20 to engage shelf 10 in a snap-fit engagement. For this purpose, support hook 20 should be made of sufficiently resilient material to permit it to be snap-fitted so as to engage, between bends 24 and 26, the portion of shelf 10 which resides between hole 11 and the upper lip of price molding 12.

It can be seen from FIGS. 3 and 4 that, since end 22 bends back so as to face toward the shelf 10, there is no exposed end of the support ring 27. This eliminates the possibility of an exposed end causing damage to a customer's eye or other portion of the body. In addition, it is noted that the ring 27, because of its curved structure, causes the suspended apertured blister packs 28 to automatically orient themselves so that the forward-most blister pack is substantially vertical, to optimize the position of the pack for display purposes. It should also be noted that since the support hook is made of a single rod-like member which is bent in a single plane to form the hook structure, it can easily be stamped of metal or molded of plastic at relatively small expense.

Figure 5:
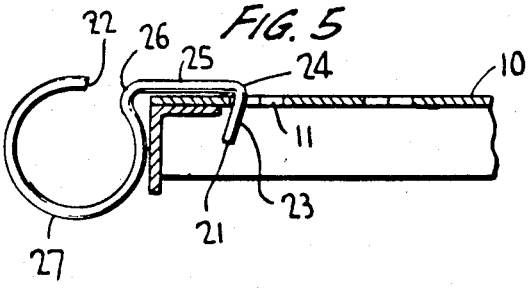
FIG. 5 is a detailed view in section of the support ring of FIG. 2 mounted along a shelf edge having a different configuration than the shelf edge illustrated in FIGS. 3 and 4.

The support hook 20 need not engage shelf 10 in a snap-fit engagement. Specifically, and referring to FIG. 5, support hook 20 may engage the shelf so as to project from a side edge 29 of the shelf rather than the shelf forward edge or price molding 12. As seen from FIG. 5, it is only necessary that bend 24 be be sufficient to cause section 23 to resist counterclockwise movement of the support hook about the side edge of the shelf when a weight, such as a blister pack, is suspended from ring 27.

Figure 6:
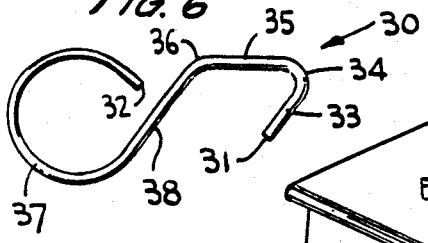
FIG. 6 is a view in plan of a second embodiment of the support ring of the present invention.
Figure 7:
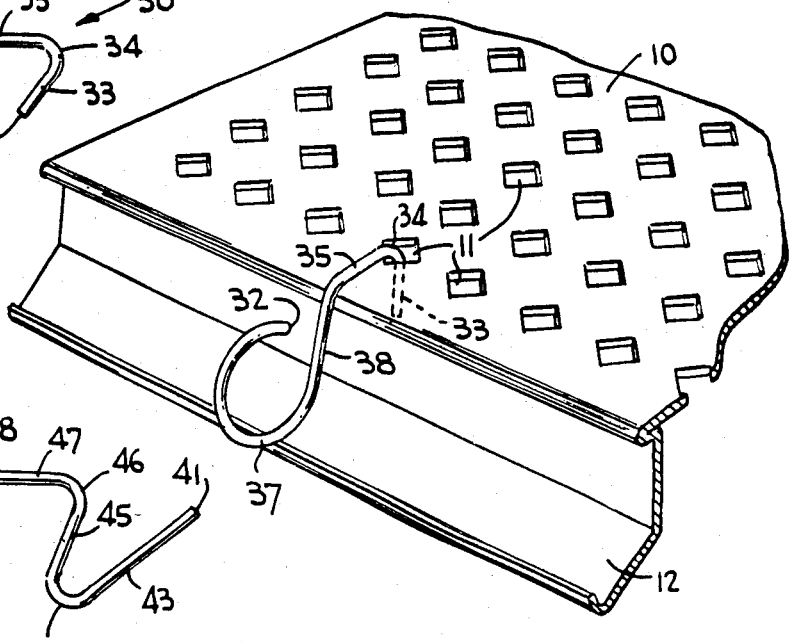
FIG. 7 is a view in perspective of the support ring of FIG. 6 shown deployed in conjunction with a shelf.

A modified form of the support hook of the present invention is illustrated as support hook 30 of FIG. 6. Support hook 30 is also an integral member in the form of a rod bent in a single plane and having ends 31 and 32. The mounting portion of the support hook includes end 31 and a first section 33 extending from that end. The bend 34, on the order of 125°, is a transition between section 33 and a further section 35. A further bend 36, on the order of 55°, serves as a transition from section 35 into section 38 which is a straight section that extends substantially parallel to the first section 33. Section 38 tangentially joins ring 37 which terminates at end 32. A gap is provided between end 32 and section 38 so as to permit blister packs to be inserted onto ring 37. As best illustrated in FIG. 7, support hook 30 is not intended to engage shelf 10 in a snap-fit. Rather, section 33 is inserted through one of the holes 11 proximate price molding 12 until insertion is stopped by bend 34. Bend 36, on the other hand, rests on the upper lip of price molding 12 so that section 38 extend obliquely downward relative to the horizontal shelf 10 and in front of the price molding 12. A portion of ring 37 extends forwardly of the price molding so that the suspended blister packs will be disposed forwardly of the price molding. The lower lip of price molding 12 serves as a stop against ring 37 to prevent rotation of the support hook 30 about the upper lip of the price molding when the ring is weighted down by the displayed elements.

Figure 8:
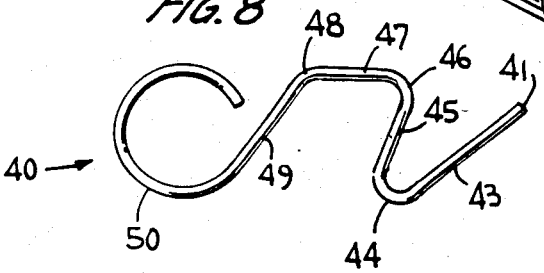
FIG. 8 is a view in plan of still another support ring of the present invention.
Figure 9:
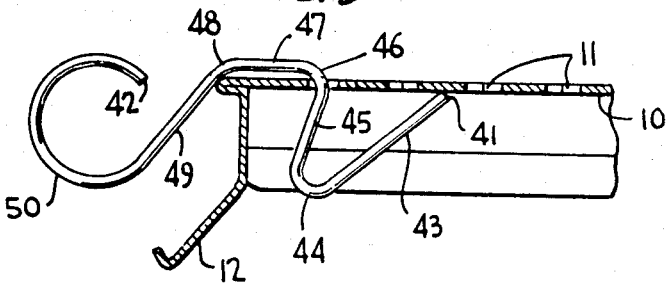
FIG. 9 is a view in section of a shelf showing the support ring of FIG. 8 engaged therewith.

Still another embodiment of the support hook of the present invention, namely support hook 40 of FIG. 8, is similar to support hook 30 of FIG. 6 but is provided with an additional stabilization section to prevent dislodging of the support hook. Specifically, support hook 40 includes opposite ends 41 and 42. A first straight section 43 of the support hook extends from end 41 and terminates in a bend 44 of approximately 140°. The structure continues with a straight section 45 which terminates in a bend 46 of approximately 110°. A further section 47, which ultimately resides parallel to the top surface of the shelf 10, extends from bend 46 to a further bend 48 which is on the order of 55°. A further section 49 extends from bend 48 into a tangential relationship with a support ring 50. Support ring 50 has a gap for insertion of apertured blister packs defined between end 42 and section 49 of the support hook. As best illustrated in FIG. 9, support hook 40 engages shelf 10 by inserting end 41 and section 43 into one of the shelf holes 11 which is located proximate an edge of the shelf or price molding 12. When bend 44 reaches the surface of the shelf 10 during insertion of the support hook, the support hook is rotated so that bend 44 and section 45 are inserted to the position illustrated wherein bend 46 serves as a stop for further insertion at hole 11. Bend 48, on the other hand, serves as a support point against the upper lip of price molding 12 or the edge of the shelf. When thusly positioned, end 41 of the support hook abuts the underside of shelf 10 so as to prevent further counterclockwise rotation of the support hook about the upper edge of price molding 12. In this position, the support ring 50 is projected forwardly of the price molding and the blister packs may be suspended freely without interference by the price molding. It may be seen, therefore, that bend 44 and section 43 are provided, in addition to the structure of FIG. 5, so as to provide additional positional stability for support ring 40.

Figure 14:
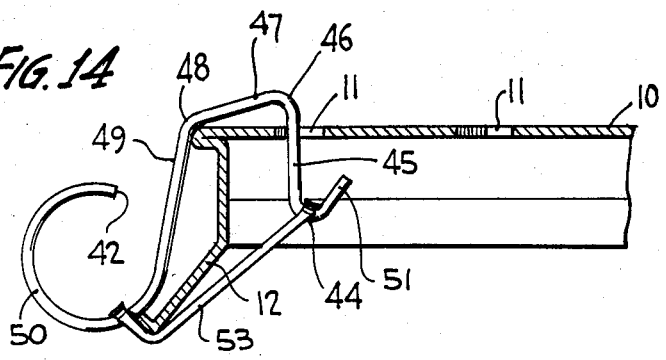
FIG. 14 is a view in section of a shelf and showing another embodiment of the support ring of the present invention secured to the shelf by an elastic band.

The support hook illustrated in FIGS. 8 and 9 may be further modified, in the manner illustrated in FIG. 14, to permit positional stabilization of the deployed support hook with the aid of an elastic band or the like. Corresponding portions of the hooks of FIGS. 9 and 14 are designated by the same reference numerals in the drawings. The difference resides in the fact that section 43, beyond bend 44 in FIG. 9, is replaced with a much shorter section 51 in the embodiment of FIG. 14. Section 51 need only be long enough to permit an elastic or rubber band 53, or the like, to be stretched from the concave side of bend 44 to the ring 50. Specifically, after the support hook is deployed on shelf 10, with section 45 extending down through holes 11 and the ring 50 disposed forwardly of the price molding 12, the elastic band is attached between ring 50 and bend 44 as illustrated. Since there is no straight line which can pass from bend 44 to ring 50 without passing through the price molding 12, the elastic band 53 must be stretched by the lowermost edge of the price molding 12. This tends to pivot the support hook about the point where bend 48 contacts the upper lip of price molding 12 such that section 47 is raised above the shelf 10 and ring 50 is lowered into contact with the lower edge of the price molding. The hook is thus pulled by elastic band 53 to contact both the upper and lower edges of the price molding. This two-point contact provides the necessary positional stability of the support hook relative to the shelf.

Figure 10:
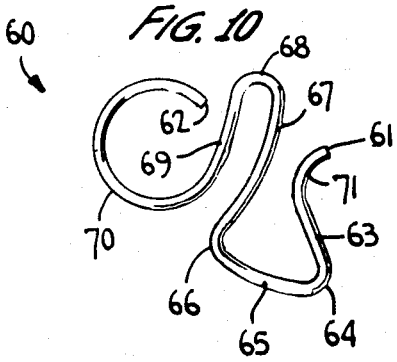
FIG. 10 is a view in plan of still another support ring formed in accordance with the features and principles of the present invention.

Still another embodiment of the present invention is illustrated in FIG. 10 wherein a support ring 60 is also fabricated from a single bent rod-like member having ends 61 and 62. A first section 71 extends from end 61 in a generally arcuate manner to subtend a bend which is on the order of approximately 85°. A second section 63 extends between section 71 and a bend 64 which is on the order of 120°. A further section 65 extends between bend 64 and a further bend 66 which is on the order of 85°. A still further section 67 extends between bend 66 and a generally U-shaped bend 68, the other leg of which is a section 69. Section 69 tangentially joins the support ring 70. The gap for support ring 70 is provided between end 62 and section 69.

Figure 11:
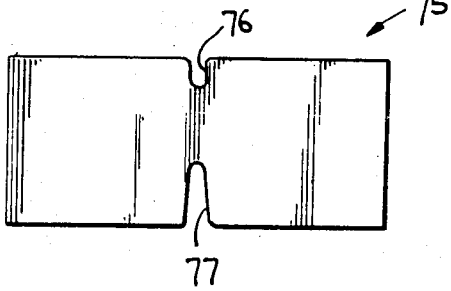
FIG. 11 is a view in plan of a support member which is configured to be used in conjunction with the support hook of FIG. 10 to secure that support hook to a price molding.
Figure 12:
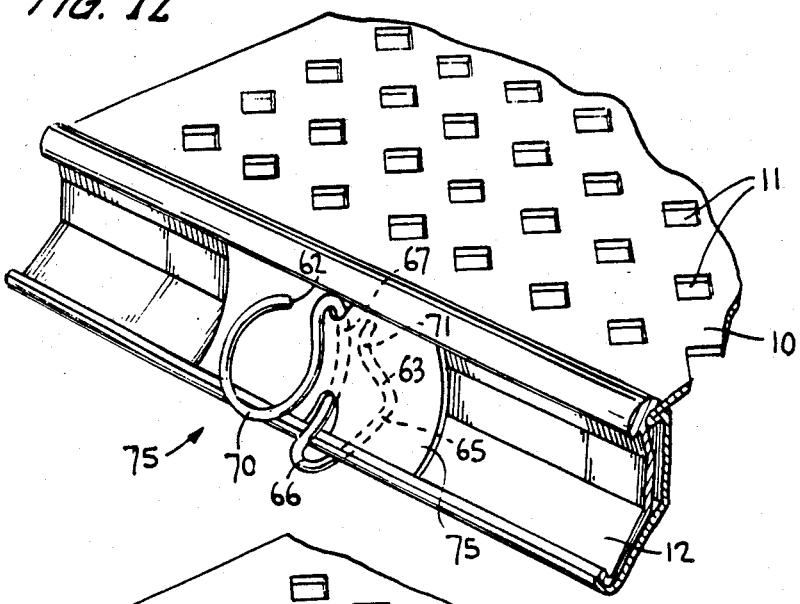
FIG. 12 is a view in perspective showing the support hook of FIG. 10 and the mounting unit of FIG. 11 deployed on a price molding of a merchandise shelf.

Support ring 70 does not require an apertured shelf (that is, a shelf with holes 11) in order to engage the shelf. Rather, support hook 60 is secured to a price molding by means of a flexible securing member 75 illustrated in FIG. 11. Securing member 75 is a generally rectangular member having two (2) long edges and two (2) short edges. The upper long edge is provided with a relatively shallow recess 76 whereas the lower long edge is provided with a relatively deep recess 77. The support member 75 is readily flexible about a central longitudinal axis extending parallel to its long edges. Member 75 may also be flexible in the opposite dimension but that is of no consequence for the present application. With reference to FIG. 12, it is seen that support hook 60 is engaged along its section 67 between support member 75 and the price molding 12 of a shelf 10. In order to so engage the support hook 60, support member 75, prior to its engagement with the price molding is positioned so that it is inserted between sections 69 and 67 of the support hook with bend 68 disposed substantially at recess 76 and section 67 extending down through recess 77. Support member 75 is then flexed and inserted into the price molding so that bend 66 extends around to the lower lip of the price molding to project sections 65, 63 and 71 behind the price molding. With the support member thusly flexed, section 67 of the support hook 60 is urged against the price molding by the support member. The support hook is thereby firmly engaged with support ring 70 extending forwardly of the price molding to support the suspended blister packs.

Figure 13:
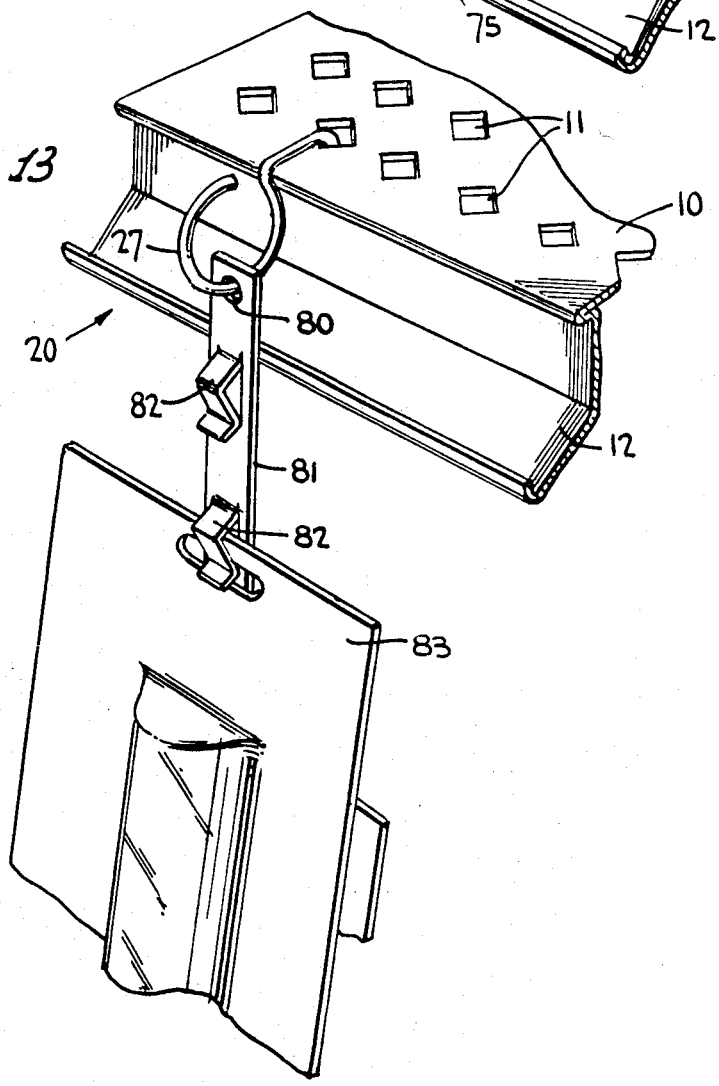
FIG. 13 is a view in perspective of the support hook of FIG. 2 shown deployed on a shelf and supporting a clip strip rather than plural blister packs as illustrated in FIG. 4.

As noted above, the support hook of the present invention is not limited to supporting apertured blister packs. For example, and with specific reference to FIG. 13, the support hook 20 is illustrated as extending through the aperture 80 of a clip strip 81. Clip strip 81 is an elongated member having aperture 80 proximate its upper end and a plurality of clips 82 secured thereto for engaging items 83 to be displayed. With support hook 20 secured to shelf 10 in the same manner described above in relation to FIG. 3, the clip strip 81 is readily inserted onto the support ring 27 so that it may be suspended therefrom forwardly of the price molding 12 secured to shelf 10.

Figure 15:
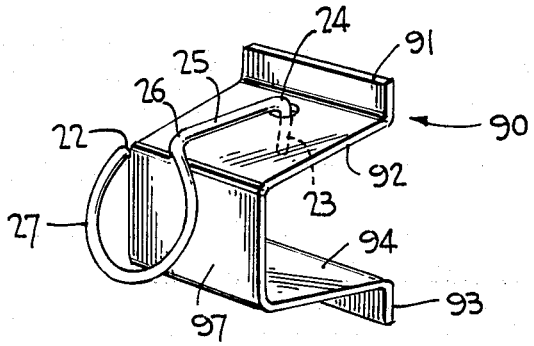
FIG. 15 is a view in perspective showing the support hook of FIG. 2 deployed in an apertured spring clip.
Figure 16:
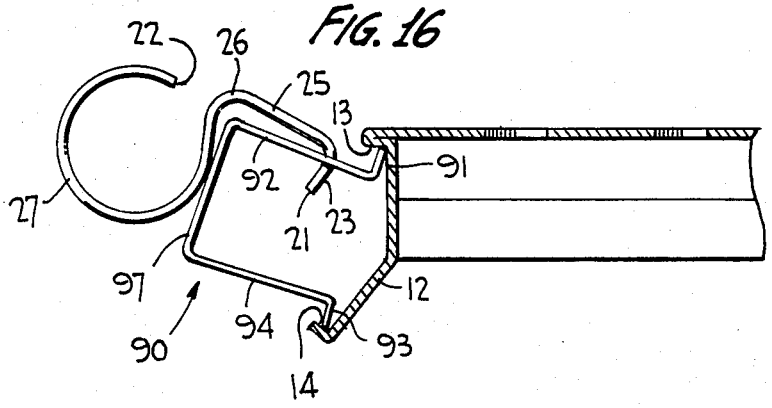
FIG. 16 is a view in section showing the assembly of FIG. 15 secured to a price molding.

As noted above in relation to the embodiment of FIGS. 11 and 12, the support hook does not require an apertured display shelf in order to be positionally stabilized with respect to the shelf. Another embodiment having this feature is illustrated in FIGS. 15 and 16 wherein a conventional spring clip 90 of metal, plastic, or similar material, has a generally U-shaped cross-section. The extremities of the clip 90 are provided with respective flanges 91, 93 which are bent approximately 90° to extend outward from the spring clip arms or sides 92, 94, respectively. The top side 92 of the spring clip is provided with a small aperture sized to receive end 21 and rod 23 of a support hook such as the support hook 20 of FIG. 2. The aperture is set back from the base or forward portion 97 of the spring clip 90 in order to permit the support hook to engage the spring clip in a snap-fit engagement. In this regard, it is preferred that the spacing between rod end 21 and the nearest portion of ring 27 is slightly less than the spacing between aperture and the junction between the side 92 and base 97 of the spring clip.

The spacing between the extremities of the flanges 91 and 93 when the spring clip is unflexed is greater than the spacing between upper groove 13 and lower groove 14 of the price molding 12. This permits the flanges to be inserted into the grooves when sides 92 and 94 are flexed toward one another. The spring clip 90 can thusly be resiliently engaged in the price molding 12 with the support hook projecting forwardly of the shelf to support blister packs and the like.

While I have described and illustrated various specific embodiments of my invention, it will be clear that variations of the details of construction which are specifically illustrated and described may be resorted to without departing from the true spirit and scope of the invention as defined in the appended claims.

I claim:

1. A support hook for supporting apertured items from a body member for purposes of display, said body member having a forward edge and at least one surface including said forward edge with a through hole defined therein and spaced from said forward edge, said support hook comprising an integral elongated rod-like member having first and second ends and bent to form, in a common plane, a supporting position and a mounting portion for securing said hook to said body member with said supporting portion projecting forwardly of said body member, said mounting portion including said first end, said supporting portion including said second end and being generally configured as a ring with a gap formed therein between said second end and said mounting portion, said gap being of sufficient size to permit said apertured items to be suspended from said ring by inserting said second end of said member through the apertured items, and wherein said mounting portion includes a first section having said first end adapted for insertion down through said through hole and a second section which extends generally above and along said body member when said hook is deployed with said first section inserted in said through hole; wherein said first section of said mounting portion includes a bend such that said first end extends generally upward toward said body member from beneath when the hook is deployed on the body member, and further comprising an elastic band stretched between said supporting portion and said bend so as to be flexed by a portion of said body member.

2. The support hook according to claim 1, wherein said first end and said supporting portion is spaced by a first distance, wherein said through hole is spaced from said forward edge of said body member by a second distance, wherein said second distance slightly exceeds the first distance, and wherein said hook is sufficiently resilient to permit it to be snap-fit onto said body member between said through hole and said forward edge when the hook is deployed on the body member.

3. The support hook according to claim 2, wherein said mounting portion includes a third section extending obliquely downward from said second section forwardly of said forward edge to tangentially join said ring when the hook is deployed on the body member.

4. A support apparatus for supporting apertured items from a generally downward projecting price molding edge of a shelf for purposes of display, said apparatus including a support hook comprising an integrally elongated rod-like member having first and second ends and bent in a common plane to form a supporting portion and a mounting portion for securing said member with said supporting portion projecting forwardly of said shelf, said mounting portion including said first end, said supporting portion including said second end, and being generally configured as a ring with a gap therein formed between said second end and said mounting portion, said gap being of sufficient size to permit said apertured items to be suspended from said ring by inserting said second end of said member through the apertured items, said apparatus further comprising means for resiliently securing said support hook to said price molding.

5. The support hook according to claim 4, wherein said mounting portion includes a first section having said first end adapted for insertion down through a hole in said shelf proximate said edge and a second section extending generally along an exposed surface of said shelf when said hook is deployed on the shelf with said first section inserted through said hole, and wherein said securing means comprises an elastic band.

6. The support hook according to claim 4, wherein said securing means comprises a spring clip which is adapted to be selectively secured to said price molding and to which said support hook is selectively attachable.

7. A support hook for supporting apertured items from a body member for purposes of display, said body member having a forward edge and at least one surface including said forward edge with a through hole defined therein and spaced from said forward edge, said support hook comprising an integral elongated rod-like member having first and second ends and bent to form, in a common plane, a supporting position and a mounting portion for securing said hook to said body member with said supporting portion projecting forwardly of said body member, said mounting portion including said first end, said supporting portion including said second end and being generally configured as a ring with a gap formed therein between said second end and said mounting portion, said gap being of sufficient size to permit said apertured items to be suspended from said ring by inserting said second end of said member through the apertured items, and wherein said mounting portion includes a first section having said first end adapted for insertion down through said through hole and a second section which extends generally above and along said body member when said hook is deployed with said first section inserted in said through hole; wherein said first section of said mounting portion includes a bend disposed beneath said one surface of said body member when the support hook is deployed on the body member, and further comprising position stabilization means for resiliently urging said support portion against said body member.

8. The support hook according to claim 7, wherein said body member is a display shelf having a price molding at its forward edge, said price molding having upper and lower spaced horizontally-extending lips, and wherein said position stabilization means comprises an elastic band stretched between said bend and said support portion so as to be flexed by said lower lip and to resiliently force said hook into contact with said upper and lower lips.

9. The support hook according to claim 8, wherein said body member is a spring clip adapted to resiliently engage a price molding of a display shelf.

10. The support hook according to claim 7, wherein said first end and said supporting portion is spaced by a first distance, wherein said through hole is spaced from said forward edge of said body member by a second distance, wherein said second distance slightly exceeds the first distance, and wherein said hook is sufficiently resilient to permit it to be snap-fit onto said body member between said through hole and said forward edge when the hook is deployed on the body member.

11. The support hook according to claim 10, wherein said mounting portion includes a third section extending obliquely downward from said second section forwardly of said forward edge to tangentially join said ring when the hook is deployed on the body member.

12. The support hook according to claim 11, wherein said body member is a display shelf having a price molding at its forward edge, said price molding having upper and lower spaced horizontally-extending lips, and wherein said position stabilization means comprises an elastic band stretched between said bend and said support portion so as to be flexed by said lower lip and to resiliently force said hook into contact with said upper and lower lips.

* * * * *